US006662589B1

(12) United States Patent
Roberts et al.

(10) Patent No.: US 6,662,589 B1
(45) Date of Patent: Dec. 16, 2003

(54) INTEGRATED HIGH PRESSURE NGL RECOVERY IN THE PRODUCTION OF LIQUEFIED NATURAL GAS

(75) Inventors: Mark Julian Roberts, Kempton, PA (US); Howard Charles Rowles, Center Valley, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/414,735

(22) Filed: Apr. 16, 2003

(51) Int. Cl.[7] ..... F25J 3/00
(52) U.S. Cl. ..... 62/425
(58) Field of Search ..... 62/618, 620, 624, 62/625

(56) References Cited

U.S. PATENT DOCUMENTS

| | | | | |
|---|---|---|---|---|
| 3,622,504 | A | 11/1971 | Strum | 208/340 |
| 3,747,359 | A | 7/1973 | Streich | 62/24 |
| 3,763,658 | A | 10/1973 | Gaumer, Jr. et al. | 62/40 |
| 4,061,481 | A | 12/1977 | Campbell et al. | 62/29 |
| 4,112,700 | A | 9/1978 | Forg | 62/28 |
| 4,155,729 | A | 5/1979 | Gray et al. | 62/18 |
| 4,203,741 | A | 5/1980 | Bellinger et al. | 62/24 |
| 4,203,742 | A | 5/1980 | Agnihotri | 62/24 |
| 4,272,269 | A | 6/1981 | Hammond et al. | 62/17 |
| 4,445,916 | A | 5/1984 | Newton | 62/17 |
| 4,445,917 | A | 5/1984 | Chiu | 62/25 |
| 4,504,296 | A | 3/1985 | Newton et al. | 62/31 |
| 4,657,571 | A | 4/1987 | Gazzi | 62/17 |
| 4,687,499 | A | 8/1987 | Aghili | 62/24 |
| 4,690,702 | A | 9/1987 | Paradowski et al. | 62/23 |
| 4,809,154 | A | 2/1989 | Newton | 364/148 |
| 4,851,020 | A | 7/1989 | Montgomery, IV | 62/24 |
| 4,881,960 | A | 11/1989 | Ranke et al. | 62/20 |
| 4,889,545 | A | 12/1989 | Campbell et al. | 62/24 |
| 4,952,305 | A | 8/1990 | Jummann | 208/340 |
| 5,291,736 | A | 3/1994 | Paradowski | 62/20 |
| 5,325,673 | A | 7/1994 | Durr et al. | 62/23 |
| 5,568,737 | A | 10/1996 | Campbell et al. | 62/621 |
| 5,771,712 | A | 6/1998 | Campbell et al. | 62/621 |
| 5,799,507 | A | 9/1998 | Wilkinson et al. | 62/621 |
| 5,992,175 | A | 11/1999 | Yao et al. | 62/621 |
| 6,023,942 | A | 2/2000 | Thomas et al. | 62/613 |
| 6,116,050 | A | 9/2000 | Yao et al. | 62/630 |
| 6,119,479 | A | 9/2000 | Roberts et al. | 62/612 |
| 6,269,655 | B1 | 8/2001 | Roberts et al. | 62/612 |
| 6,347,532 | B1 | 2/2002 | Agrawal et al. | 62/612 |
| 6,401,486 | B1 | 6/2002 | Lee et al. | 62/630 |

FOREIGN PATENT DOCUMENTS

| | | | |
|---|---|---|---|
| WO | 99/60316 | 11/1999 | F25J/1/02 |
| WO | 01/88447 | 11/2001 | F25J/3/00 |

OTHER PUBLICATIONS

Paradowski et al., "*Liquefaction of Associated Gases*", 7$^{th}$ International Conference on LNG, May 15–19, 1983.

*Primary Examiner*—Henry Bennett
*Assistant Examiner*—Malik N. Drake
(74) *Attorney, Agent, or Firm*—John M. Fernbacher

(57) ABSTRACT

Process for the recovery of components heavier than methane from natural gas, wherein the process comprises (a) cooling a natural gas feed to provide a cooled natural gas feed and introducing the cooled natural gas feed into an absorber column at a first location therein; (b) withdrawing from the absorber column a first overhead vapor stream depleted in components heavier than methane and a bottoms stream enriched in components heavier than methane; (c) introducing a methane-rich reflux stream at a second location in the absorber column above the first location; (d) separating the bottoms stream into a stream enriched in methane and one or more streams enriched in components heavier than ethane; and (e) introducing an absorber liquid comprising components heavier than ethane into the absorber column at a location between the first location and the second location.

31 Claims, 1 Drawing Sheet

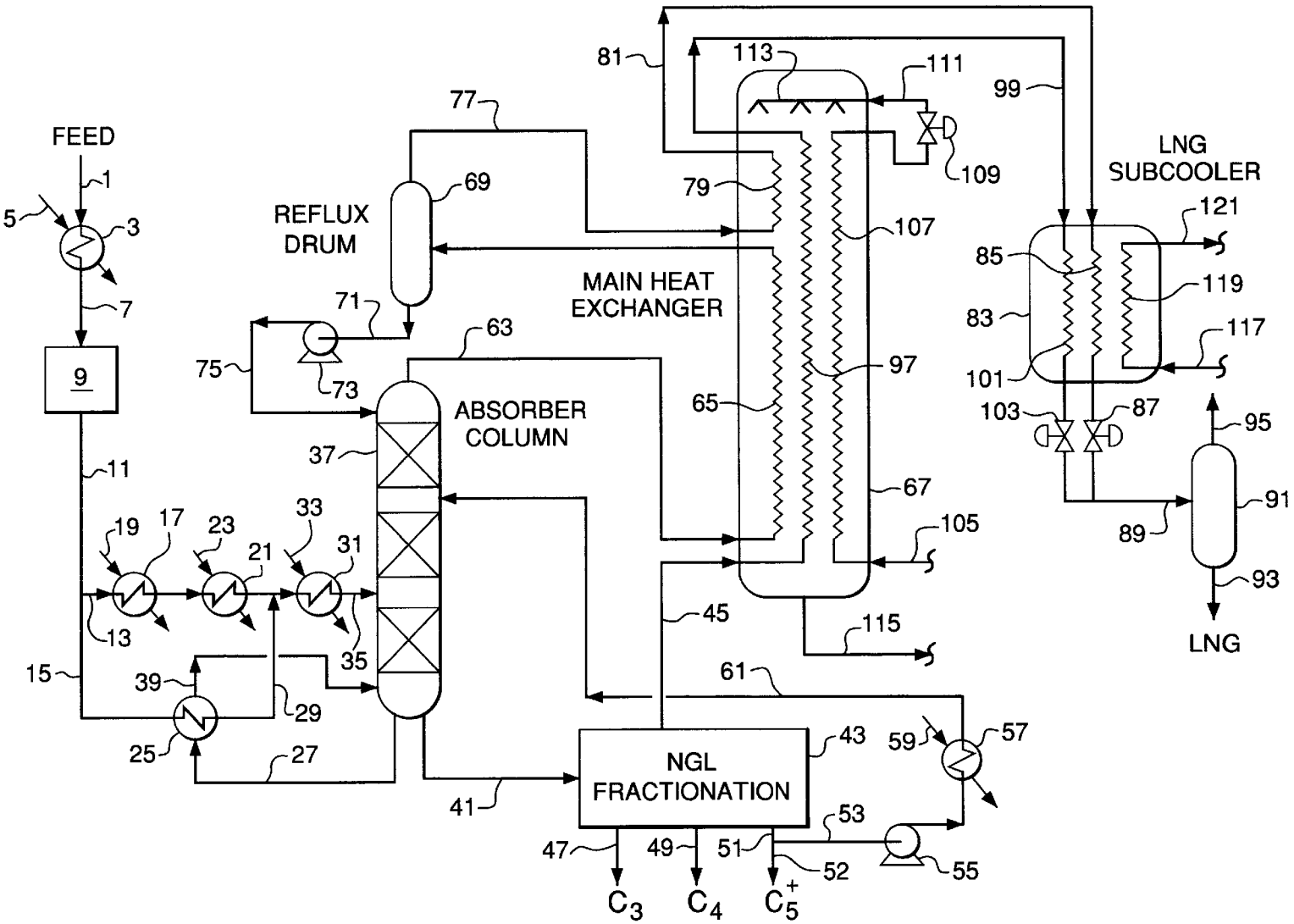
LNG SUBCOOLER
LNG
FEED
MAIN HEAT EXCHANGER
ABSORBER COLUMN
REFLUX DRUM
NGL FRACTIONATION
$C_5^+$
$C_4$
$C_3$

INTEGRATED HIGH PRESSURE NGL RECOVERY IN THE PRODUCTION OF LIQUEFIED NATURAL GAS

BACKGROUND OF THE INVENTION

Raw natural gas comprises primarily methane and also contains numerous minor constituents which may include water, hydrogen sulfide, carbon dioxide, mercury, nitrogen, and light hydrocarbons typically having two to six carbon atoms. Some of these constituents, such as water, hydrogen sulfide, carbon dioxide, and mercury, are contaminants which are harmful to downstream steps such as natural gas processing or the production of liquefied natural gas (LNG), and these contaminants must be removed upstream of these processing steps. The hydrocarbons heavier than methane typically are condensed and recovered as natural gas liquids (NGL) and fractionated to yield valuable hydrocarbon products.

NGL recovery utilizes cooling, partial condensation, and fractionation steps that require significant amounts of refrigeration. This refrigeration may be provided by work expansion of pressurized natural gas feed and vaporization of the resulting condensed hydrocarbons. Alternatively or additionally, refrigeration may be provided by external closed-loop refrigeration using a refrigerant such as propane. It is desirable to recover NGL from pressurized natural gas without reducing the natural gas pressure significantly. This allows the natural gas product (for example, pipeline gas or LNG) to be provided at or slightly below the feed pressure so that feed and/or product recompression is not required.

In order to recover NGL and natural gas products at near feed pressure while minimizing refrigeration power consumption, improved NGL recovery processes are needed. The present invention, which is described below and defined by the claims that follow, provides an improved lean oil absorption-type NGL recovery process which can be operated at pressures significantly above the critical pressure of methane, wherein the natural gas feed pressure need not be reduced in the process.

BRIEF SUMMARY OF THE INVENTION

Embodiments of the invention include a process for the recovery of components heavier than methane from natural gas, wherein the process comprises (a) cooling a natural gas feed to provide a cooled natural gas feed and introducing the cooled natural gas feed into an absorber column at a first location therein;

(b) withdrawing from the absorber column a first overhead vapor stream depleted in components heavier than methane and a bottoms stream enriched in components heavier than methane;

(c) introducing a methane-rich reflux stream at a second location in the absorber column above the first location;

(d) separating the bottoms stream into a stream enriched in methane and one or more streams enriched in components heavier than ethane; and (e) introducing an absorber liquid comprising components heavier than ethane into the absorber column at a location between the first location and the second location.

The process may further comprise combining all or a portion of any of the one or more streams enriched in components heavier than ethane in (d) with the methane-rich reflux stream in (c). Alternatively, the process may further comprise withdrawing all or a portion of any of the one or more streams enriched in components heavier than ethane in (d) as a product stream. The natural gas feed may be at a pressure above 600 psia.

The absorber liquid may comprise components obtained from any of the one or more streams enriched in components heavier than ethane in (d). The absorber liquid may contain greater than 50 mole % of hydrocarbons containing five or more carbon atoms. Alternatively, the absorber liquid may contain greater than 50 mole % of hydrocarbons containing four or more carbon atoms. In another alternative, the absorber liquid may contain greater than 50 mole % of hydrocarbons containing three or more carbon atoms.

The absorber liquid may be cooled by indirect heat exchange with a vaporizing recirculating refrigerant prior to being introduced into the absorber column. This vaporizing recirculating refrigerant may be propane.

The process may further comprise cooling and partially condensing the first overhead vapor stream to form a two-phase stream, separating the two-phase stream to provide a second overhead vapor stream and the methane-rich reflux stream in (c). The second overhead vapor stream may be recovered as a product stream depleted in components heavier than methane. All or a portion of any of the one or more streams enriched in methane in (d) may be combined with the first overhead vapor stream prior to separating the two-phase stream.

The refrigeration for cooling and partially condensing the first overhead vapor stream may be provided by indirect heat exchange with a vaporizing refrigerant. This vaporizing refrigerant may be a multi-component refrigerant.

The process may further comprise cooling, condensing, and subcooling the second overhead vapor stream to provide a liquefied natural gas product. All or a portion of the refrigeration required to cool, condense, and subcool the second overhead vapor stream may be provided by indirect heat exchange with a vaporizing refrigerant. This vaporizing refrigerant may be a multi-component refrigerant.

All or a portion of the refrigeration required to cool, condense, and subcool the second overhead vapor stream may be provided by indirect heat exchange with a cold refrigerant provided by work expansion of a compressed refrigerant comprising nitrogen.

All or a portion of the cooling of the natural gas feed may be provided by indirect heat exchange with one or more streams of vaporizing refrigerant. This vaporizing refrigerant may be propane.

The process may further comprise providing a portion of the cooling of the natural gas feed by indirect heat exchange with a liquid bottoms stream from the absorber column, thereby providing a vaporized bottoms stream, and introducing the vaporized bottoms stream into the absorber column to provide boilup vapor.

The process may further comprise cooling, condensing, and subcooling the stream enriched in methane in (d) to provide a liquefied methane-rich product. All or a portion of the refrigeration required to cool, condense, and subcool the stream enriched in methane may be provided by indirect heat exchange with the vaporizing refrigerant. Alternatively, all or a portion of the refrigeration required to cool, condense, and subcool the stream enriched in methane may be provided by indirect heat exchange with a cold refrigerant provided by work expansion of a compressed refrigerant comprising nitrogen. The liquefied methane-rich product may be combined with the liquefied natural gas product.

Embodiments of the invention also include a system for recovery of components heavier than methane from natural gas, wherein the system comprises (a) an absorber column for separating natural gas into a methane-rich stream and a stream enriched in components heavier than methane;

(b) cooling means to cool a natural gas feed to provide a cooled natural gas feed and means for introducing the cooled natural gas feed into the absorber column at a first location therein;

(c) means for withdrawing from the absorber column a first overhead vapor stream depleted in components heavier than methane and a bottoms stream enriched in components heavier than methane;

(c) means for introducing a methane-rich reflux stream at a second location in the absorber column above the first location;

(d) separation means for separating the bottoms stream into a stream enriched in methane and one or more streams enriched in components heavier than ethane; and (e) means for introducing an absorber liquid comprising components heavier than ethane into the absorber column at a location between the first location and the second location.

The system may further comprise means for cooling and partially condensing the first overhead vapor stream to form a two-phase stream and means for separating the two-phase stream to provide a second-overhead vapor stream and the methane-rich reflux stream. The system may further comprise a main heat exchanger having flow passages therein for cooling and partially condensing the first overhead vapor stream by indirect heat exchange with a vaporizing multi-component refrigerant, having flow passages therein for cooling a compressed multi-component refrigerant, pressure reduction means for reducing the pressure of the multi-component refrigerant to yield the vaporizing multi-component refrigerant, and means for distributing the vaporizing multi-component refrigerant in the main heat exchanger.

The system may further comprise additional flow passages in the main heat exchanger for cooling and at least partially condensing the second overhead vapor stream to provide a liquefied natural gas product. In addition, the system may further comprise a product heat exchanger wherein the liquefied natural gas product is further cooled by indirect heat exchange with a cold refrigerant provided by work expansion of a compressed refrigerant comprising nitrogen.

BRIEF DESCRIPTION OF SEVERAL VIEWS OF THE DRAWINGS

The single FIGURE is a schematic flow diagram illustrating an embodiment of the invention.

DETAILED DESCRIPTION OF THE INVENTION

Natural gas liquids (NGL) are recovered from pressurized natural gas according to embodiments of the present invention by an absorption process in which a cooled natural gas feed stream is introduced into an absorber column, a methane-rich reflux stream is provided by partially condensing the absorber column overhead and returning the condensate as reflux to the column, and an absorber liquid is introduced into the absorber column at an intermediate point. This absorber liquid may be provided by fractionating the liquid bottoms stream from the absorber column to provide one or more liquid streams containing hydrocarbons heavier than ethane and returning a portion or all of at least one of these streams to provide the absorber liquid. The absorber liquid is introduced into the absorber column at a location intermediate the locations at which the feed and methane-rich reflux streams are introduced. This NGL recovery process may be integrated with a natural gas liquefaction process such that a portion of the refrigeration provided for final gas liquefaction is utilized for condensing the absorber column overhead. The fractionation process that separates the NGL components preferably is utilized to produce the absorber liquid.

An example embodiment of the invention is illustrated in the single Figure wherein refrigeration for NGL recovery and LNG production is provided by a combination of high-level propane refrigeration, intermediate-level refrigeration using a mixed refrigerant comprising methane and ethane, and low-level gas expansion refrigeration. The propane refrigeration is utilized to cool the pressurized pretreated natural gas feed to the operating temperature of the NGL absorber column and to condense the mixed refrigerant. The mixed refrigerant is utilized to cool and condense the methane-rich overhead vapor from the NGL absorber column and to provide the methane-rich reflux stream to the top of the absorber column. Gas expansion refrigeration is utilized to subcool the condensed LNG to a sufficient level to minimize flash vaporization losses when the LNG is reduced to storage pressure, which is generally less than about 20 psia.

Any other type of refrigeration system or systems may be used to provide the refrigeration for NGL recovery and LNG production. For example, this refrigeration may be supplied by a methane, ethane or ethylene, and propane cascade refrigeration system, a single refrigeration system using a mixed refrigerant, a propane precooled mixed refrigerant refrigeration system, or a dual mixed refrigerant refrigeration system. Various types of gas expansion refrigeration cycles can be incorporated into any of these refrigeration systems. Natural gas and/or refrigerant expanders, handling either gas or liquid process streams, also can be incorporated into the refrigeration system when appropriate. The basic embodiment of the invention is independent of the type of refrigeration used in the NGL recovery and LNG production.

In this exemplary embodiment, pressurized natural gas feed in line 1, which has been pretreated to remove the acid gas components hydrogen sulfide and carbon dioxide, is cooled in heat exchanger 3 by heat exchange with vaporizing propane refrigerant provided via line 5. Precooled feed gas in line 7, typically at 600 to 900 psia and 60 to 80° F., is treated further in treatment system 9 to remove water and mercury. The feed gas at this point contains primarily methane with smaller concentrations of one or more heavier hydrocarbons in the $C_2$ to $C_6$ range. Precooled and pretreated feed gas in line 11 is split into two portions via lines 13 and 15, and the portion of gas in line 13 is cooled successively in heat exchanger 17 by vaporizing propane refrigerant provided via line 19 and in heat exchanger 21 by vaporizing propane refrigerant provided via line 23. The other portion of gas in line 15 is cooled in heat exchanger 25 by a vaporizing process stream (later described) provided via line 27. Cooled feed in line 29 is combined with cooled feed from heat exchanger 21 and the combined feed stream is further cooled in heat exchanger 31 by vaporizing propane refrigerant via line 33.

The combined feed stream in line 35, typically at −20 to −40° F., passes into absorber column 37 at an intermediate point or first location therein. This column separates the feed into a bottoms liquid enriched in heavier hydrocarbons and a first overhead vapor enriched in methane. One portion of the bottoms liquid is withdrawn via line 27, is vaporized in heat exchanger 25 as earlier described, and the resulting vapor flows via line 39 to provide boilup vapor in absorber column 37. The other bottoms liquid, generally described as natural gas liquid (NGL), flows via line 41 to NGL fractionation system 43. Here, the NGL is separated using well-known distillation processes including de-ethanizer, de-propanizer, and/or de-butanizer columns to provide two or more hydrocarbon fractions. In this example, bottoms stream in line 41 is separated into a light fraction in line 45 containing methane and ethane, a fraction containing primarily propane in line 47, a fraction containing primarily $C_4$ hydrocarbons in line 49, and a fraction containing primarily $C_5$ and heavier hydrocarbons in line 51. A separate ethane-enriched fraction also can be produced if desired.

A portion of the $C_5$ and heavier hydrocarbons in line 51 is withdrawn via line 53, pumped by pump 55, cooled in heat exchanger 57 against vaporizing propane refrigerant via line 59, and returned via line 61 to provide an absorber liquid to absorber column 37 at a location above the first location at which the feed stream is introduced via line 35. The absorber liquid serves to absorb heavier hydrocarbons from the feed gas passing upward through the absorber column. The remainder of the $C_5$ and heavier hydrocarbons is withdrawn via line 52.

In an alternative embodiment, portions of the $C_4$ and/or $C_3$ hydrocarbons in lines 49 and 47 may be withdrawn and introduced into line 53 to form a somewhat lighter absorber liquid. In another embodiment, the absorber liquid may comprise $C_3$ and/or $C_4$ hydrocarbons without $C_5^+$ hydrocarbons. Any hydrocarbon liquid or mixture of liquids recovered in NGL fractionation system 43 can be used as the absorber liquid in absorber column 37. The choice of the composition of the absorber liquid will be determined by the desired composition of the final LNG product and the desired recovery of specific NGL components.

In very large LNG production facilities, multiple parallel liquefaction trains may be required, each of which would include feed pretreatment and cooling steps, absorber column 37, main heat exchanger 67, LNG subcooler 83, and associated vessels and piping. A common NGL fractionation system may be used for fractionating the combined NGL streams condensed in the multiple gas liquefaction trains. In this embodiment, the absorber liquid for each of the absorber columns would be provided from this common NGL fractionation system.

Overhead vapor containing primarily methane with minor amounts of ethane, propane, and $C_5^+$ hydrocarbons, typically at −15 to −35° F., is withdrawn from absorber column 37 via line 63, cooled and partially condensed in representative flow passage 65 of main heat exchanger 67, and separated into vapor and liquid streams in separator vessel or reflux drum 69. The separated liquid stream, which contains primarily methane with a major portion of the ethane, propane, and $C_5^+$ hydrocarbons in the overhead from absorber column 37, is withdrawn from reflux drum 69 via line 71. The liquid is pumped by pump 73 and flows via line 75 to provide the methane-rich reflux to the top of absorber column 37 at a second location above the first location at which the absorber liquid is introduced via line 61.

The methane-rich second overhead vapor is withdrawn from reflux drum 69 via line 77 and is cooled and condensed to form liquefied natural gas (LNG) in representative flow passage 79 in main heat exchanger 67. Liquid at −150 to −180° F. flows via line 81 to LNG subcooler heat exchanger 83, where it is subcooled in representative flow passage 85 to −180 to −240° F. The subcooled liquid is flashed across valve 87, passed via line 89 into product drum 91, and separated into final LNG product in line 93 and residual flash gas in line 95.

The methane and ethane in line 45 recovered in NGL fractionation system 43 is cooled and condensed in representative flow passage 97 in main heat exchanger 67 to yield additional liquid product. The liquid product is withdrawn via line 99, subcooled in representative flow passage 101 in LNG subcooler 83, flashed across valve 103, and passed via line 89 into product drum 91 to provide additional LNG product.

Refrigeration for the process described above may be provided, for example, in a first or warmest temperature range by recirculating liquid propane refrigerant, in a second or intermediate temperature range by a recirculating multi-component liquid refrigerant, and in a third or coldest temperature range by a cold gaseous refrigerant. In one embodiment, liquid propane refrigerant at several temperature levels in lines 5, 19, 23, 33, and 57 may be provided by any recirculating propane refrigeration system of the types well-known in the art. Other refrigerants, for example, propylene or Freon, may be used instead of propane in the first or warmest temperature range.

A compressed multi-component liquid refrigerant may be provided via line 105 to main heat exchanger 67, wherein the refrigerant is subcooled in representative flow passage 107, flashed across valve 109, and introduced via line 111 and distributor 113. The multi-component refrigerant is vaporized within main heat exchanger 67 to provide refrigeration therein and the vaporized refrigerant is withdrawn via line 115 and returned to a refrigerant compression and condensation system (not shown). Refrigeration to LNG subcooler 83 may be provided by a cold refrigerant, for example nitrogen or a nitrogen-containing mixture via line 117, that is warmed in representative flow passage 119 to provide refrigeration in subcooler 83. Warmed refrigerant is returned via line 121 to a compression and gas expansion system (not shown) that provides the cold refrigerant in line 117. Alternatively, refrigeration for the NGL recovery and LNG production may be supplied by a methane, ethane or ethylene, and propane cascade refrigeration system, a single refrigeration system using a mixed refrigerant, a propane precooled mixed refrigerant refrigeration system, or a dual mixed refrigerant refrigeration system. Various types of gas expansion refrigeration cycles can be incorporated into any of these refrigeration systems.

This process is a modified lean oil ($C_4$–$C_6^+$) absorption type NGL recovery process that utilizes a common refrigeration system to produce LNG and to recover the NGL. The intermediate-level refrigeration, e.g., ethane, ethylene or multi-component refrigerant refrigeration, required to separate the NGL from the feed gas is a small fraction of the total refrigeration required to produce the LNG.

A methane-rich reflux liquid for the NGL absorber column is generated during the cooling of the methane-enriched absorber column overhead vapor that also contains most of the $C_4$–$C_6^+$ components which are flashed at the introduction of the $C_4$–$C_6^+$ absorber liquid into the column. The introduction of these heavy hydrocarbons at the top of the absorber column increases the critical pressure of the upper column section vapor and liquid mixtures and allows the column to be operated at significantly higher pressure, e.g., above the critical pressure of methane (673 psia) such that the natural gas feed pressure need not be reduced. A portion of the $C_4$–$C_6^+$ absorber liquid or another heavy hydrocarbon liquid or mixture of liquids produced in fractionation section 43 optionally may be mixed with the methane-rich reflux liquid in line 71 or line 75 or with the first overhead vapor stream 63 from absorber column 37 prior to or after cooling in flow passage 65 of main heat exchanger 67. This would further increase the critical pressure of the vapor and liquid mixtures at the top of the absorber column and allow the column to be operated at a slightly higher pressure if desired.

The process also utilizes the fractionation process required to separate the NGL components to produce the heavy hydrocarbon ($C_4$–$C_6^+$) absorber liquid which permits the NGL to be recovered without reducing the pressure of the natural gas feed stream.

Operating the LNG production facility at the highest possible pressure raises the condensing temperature range of the methane-rich LNG stream and significantly reduces the energy required to provide the refrigeration for the liquefaction process. Introducing the methane-rich reflux liquid into the NGL absorber column section above the $C_4$–$C_6^+$ absorber liquid feed point also avoids the problem of heavy hydrocarbon contamination of the final LNG product.

When NGL recovery is not required, this modified lean oil absorption process also can be used to remove from the natural gas feed stream heavy hydrocarbons having high freezing points. This will prevent freezing and plugging at the low temperatures required for LNG production. In this case, the fractionation section might, for example, consist only of a de-butanizer column with associated reboiler and overhead condenser to produce a heavy hydrocarbon ($C_5^+$) absorber liquid as the bottom product and reject lighter components overhead. These lighter components optionally may be recovered as LNG. If a $C_4^+$ heavy hydrocarbon absorber liquid were used, the fractionation section might include only a de-propanizer column with associated reboiler and overhead condenser to produce a heavy hydrocarbon ($C_4^+$) absorber liquid as the bottom product and reject lighter components overhead.

Optionally, the modified lean oil absorption process described above may be operated without liquefying the processed natural gas. This would allow the natural gas feed to be processed for NGL recovery and the purified natural gas product to be provided at near feed pressure, which is advantageous when the natural gas product is transported as pipeline gas.

In an alternative embodiment, the feed would be introduced into absorber column 37 at the bottom of the column, reboiler 25 would not be used, and the column would be operated with only a rectification section. The bottoms liquid from this alternative absorber column would be separated in a reboiled demethanizer column as part of NGL fractionation system 43.

EXAMPLE

A process simulation of the process described above was carried out to illustrate an embodiment of the present invention. Referring to the FIGURE, natural gas is pretreated for acid gas ($CO_2$ and $H_2S$) removal (not shown) to provide a pretreated feed in line 1 at 137,824 lb moles/hr having a composition of (in mole %) 3.9% nitrogen, 87.0% methane, 5.5% ethane, 2.0% propane, 0.9% butanes and 0.7% pentane and heavier hydrocarbons at 98° F. and 890 psia. The feed is precooled in heat exchanger 3 with high-level propane refrigerant from line 5 to about 80° F. prior to additional pretreatment process 9 to remove water and mercury.

The natural gas feed in line 11 is further cooled to −27° F. with three additional levels of propane refrigerant in heat exchangers 17, 21, and 31, and is fed via line 35 to NGL absorber column 37. A portion of the feed gas in line 15 is cooled in absorber column reboiler 25 to provide reboil vapor via line 39 to the bottom of absorber column 37. A heavy hydrocarbon ($C_5$–$C_6^+$) absorber liquid from fractionation section 43, having a flow rate of 5835 lbmoles/hour and containing 0.5 mole % butanes, 42.6 mole % pentanes, and 56.9 mole % $C_6^+$ hydrocarbons at −27° F. and 847 psia, is fed via line 61 to the NGL absorber column 37. This absorber liquid is fed to absorber column 37 at a point intermediate the natural gas feed point and the top of the column, wherein the absorber liquid absorbs most of the $C_3$ and heavier hydrocarbons from the feed in line 35.

A methane-enriched first overhead vapor is withdrawn from NGL absorber column 37 via line 63 at a flow rate of 131,998 lbmoles/hour and contains (in mole %) 4.1% nitrogen, 90.9% methane, 4.4% ethane, 0.2% propane 0.015% butanes, and 0.4% pentane and heavier hydrocarbons at −21° F. and 837 psia. This overhead vapor is cooled and partially condensed in the warm end of main heat exchanger 67 and flows to reflux drum 69 at −86° F. and 807 psia. Condensed liquid is withdrawn via line 71 at a flow rate of 5726 lbmoles/hour containing (in mole %) 1.4% nitrogen, 74.5% methane, 15.2% ethane, 1.2% propane, 0.2% butanes and 7.6% pentane and heavier hydrocarbons. This methane-rich liquid is returned by reflux pump 73 via line 75 to the top of NGL absorber column 37 as reflux to absorb most of the $C_5^+$ hydrocarbons which are flashed at the introduction of the absorber liquid into the column via line 61. The main heat exchanger 67 is refrigerated by a vaporizing methane-ethane mixed refrigerant supplied via line 105 and vaporized refrigerant is returned via line 115 to a compression, cooling, and condensation system (not shown).

Liquid from the bottom of NGL absorber column 37 is withdrawn via line 41 at a flow rate of 17,387 lbmoles/hour and contains (in mole %) 24.6% methane, 15.0% ethane, 15.2% propane, 7.1% butanes and 38.0% pentane and heavier hydrocarbons at 72° F. and 844 psia. This bottoms liquid flows to NGL fractionation section 43, which includes de-ethanizer, de-propanizer and de-butanizer columns with associated reboilers and overhead condensers (not shown). The de-ethanizer column produces an overhead methane-ethane ($C_1$–$C_2$) vapor product at a flow rate of 6896 lbmoles/hour containing (in mole %) 62.1% methane, 37.8% ethane and 0.1% propane at −23° F. and 450 psia. This methane-ethane vapor flows via line 45 to main heat exchanger 67, is cooled and condensed in representative flow passage 97, and is withdrawn as liquid via line 99.

The de-propanizer column in fractionation section 43 produces a liquid overhead product in line 47 containing 99.5 mole % propane at a flow rate of 2588 lbmoles/hour at 120° F. and 245 psia. The de-butanizer column in fractionation section 43 produces a liquid overhead that is withdrawn as product via line 49 containing 95 mole % butanes at a flow rate of 1269 lbmoles/hour at 113° F. and 78 psia. The de-butanizer column also produces a $C_5^+$ liquid bottoms product at a flow rate of 6634 lbmoles/hour containing 0.5 mole % butanes, 42.6 mole % pentanes, and 56.9% mole $C_6^+$ hydrocarbons at 98° F. and 83 psia. A portion of this $C_5^+$ liquid bottoms is withdrawn as product via line 52 at a flow rate of 799 lbmoles/hour and the remainder is withdrawn via line 53 and pump 55 at a flow rate of 5835 lbmoles/hour. This stream is cooled in heat exchanger 57 to −27° F. with propane refrigerant supplied via line 59, and the cooled stream flows via line 61 to provide the absorber liquid to NGL absorber column 37 as earlier described.

The second overhead vapor from the top of reflux drum 69 is withdrawn via line 77 at a flow rate of 126,272 lbmoles/hour and contains (in mole %) 4.3% nitrogen, 91.6% methane, 3.9% ethane 0.1% propane and 0.1% butane and heavier hydrocarbons at −86° F. and 807 psia. This vapor flows to main heat exchanger 67 where it is cooled and totally condensed in representative flow passage 79 to form an intermediate liquefied natural gas (LNG) product at −177° F. in line 81. This intermediate liquid product is subcooled to −237° F. in LNG subcooler 83 in representative flow passage 85, flashed to 15.2 psia across valve 87, and flows via line 89 to final product separator vessel 91. The other liquid in line 99 (earlier described) is subcooled in LNG subcooler 83 in representative flow passage 101, flashed across valve 103, and also flows via line 89 to final product separator vessel 91. Final LNG product is withdrawn via line 93 to storage and flash gas is withdrawn via line 95 for use as fuel. Refrigeration for LNG subcooler 83 is provided by cold nitrogen refrigerant in line 117, which warms in representative flow passage 119, and warmed nitrogen is withdrawn via line 121 and returned to a compression and work expansion system (not shown) to provide return nitrogen refrigerant via line 117.

This exemplary process recovers as NGL products 92.5% of the propane, 98.6% of the butanes, and 99.6% of the $C_6$ and heavier hydrocarbons in the natural gas feed. Refrigeration for the NGL separation process is obtained as a portion of the refrigeration provided for liquefaction of the natural gas product. About 74% of the pentanes in the feed gas are recovered as NGL product in this example, and this level is sufficient to reduce the concentration in the methane-rich LNG product to prevent hydrocarbon freezeout and plugging of the cold equipment downstream of absorber column 37. Higher levels of propane recovery could be obtained if desired by increasing the flow of primary $C_5^+$ absorber liquid via line 61 to NGL absorber column 37. However, this would also require a corresponding increase in the flow of methane-rich reflux via line 75 to the top of absorber column 37. The higher flows of absorber liquid via line 61 and methane-rich reflux liquid via line 75 to NGL absorber column 37 would increase the amount of mid-level refrigeration required for the process, which is supplied by the methane-ethane mixed refrigerant via line 105 in this example.

If mostly $C_4$ hydrocarbons were used as the absorber liquid or if $C_4$ hydrocarbons were added to the $C_5$–$C_6^+$ absorber liquid in this example, the recovery of $C_5$ hydrocarbons would be increased but the recovery of $C_4$ hydrocarbons as NGL product in line 49 would be reduced. Optionally, propane could be used for at least a portion of the absorber liquid provided via line 61, but this would significantly reduce the recovery of propane as a final product via line 47. The selection of the composition of the absorber liquid can be determined by the value of the heavier hydrocarbons when recovered as NGL products relative to their value as part of the final LNG product. The absorber liquid provided via line 61 can be any combination of heavy hydrocarbon liquid or mixture of liquids produced in NGL fractionation section 43.

What is claimed is:

1. A process for the recovery of components heavier than methane from natural gas, wherein the process comprises (a) cooling a natural gas feed to provide a cooled natural gas feed and introducing the cooled natural gas feed into an absorber column at a first location therein;

(b) withdrawing from the absorber column a first overhead vapor stream depleted in components heavier than methane and a bottoms stream enriched in components heavier than methane;

(c) introducing a methane-rich reflux stream at a second location in the absorber column above the first location;

(d) separating the bottoms stream into a stream enriched in methane and one or more streams enriched in components heavier than ethane; and (e) introducing an absorber liquid comprising components heavier than ethane into the absorber column at a location between the first location and the second location.

2. The process of claim 1 which further comprises combining all or a portion of any of the one or more streams enriched in components heavier than ethane in (d) with the methane-rich reflux stream in (c).

3. The process of claim 1 which further comprises withdrawing all or a portion of any of the one or more streams enriched in components heavier than ethane in (d) as a product stream.

4. The process of claim 1 wherein the natural gas feed is at a pressure above 600 psia.

5. The process of claim 1 wherein the absorber liquid comprises components obtained from any of the one or more streams enriched in components heavier than ethane in (d).

6. The process of claim 1 wherein the absorber liquid contains greater than 50 mole % of hydrocarbons containing five or more carbon atoms.

7. The process of claim 1 wherein the absorber liquid contains greater than 50 mole % of hydrocarbons containing four or more carbon atoms.

8. The process of claim 1 wherein the absorber liquid contains greater than 50 mole % of hydrocarbons containing three or more carbon atoms.

9. The process of claim 1 wherein the absorber liquid is cooled by indirect heat exchange with a vaporizing recirculating refrigerant prior to being introduced into the absorber column.

10. The process of claim 9 wherein the vaporizing recirculating refrigerant is propane.

11. The process of claim 1 which further comprises cooling and partially condensing the first overhead vapor stream to form a two-phase stream, separating the two-phase stream to provide a second overhead vapor stream and the methane-rich reflux stream in (c).

12. The process of claim 11 wherein the second overhead vapor stream is recovered as a product stream depleted in components heavier than methane.

13. The process of claim 11 which further comprises combining all or a portion of any of the one or more streams enriched in methane in (d) with the first overhead vapor stream prior to separating the two-phase stream.

14. The process of claim 11 wherein refrigeration for cooling and partially condensing the first overhead vapor stream is provided by indirect heat exchange with a vaporizing refrigerant.

15. The process of claim 14 wherein the vaporizing refrigerant is a multi-component refrigerant.

16. The process of claim 11 which further comprises cooling, condensing, and subcooling the second overhead vapor stream to provide a liquefied natural gas product.

17. The process of claim 16 wherein all or a portion of the refrigeration required to cool, condense, and subcool the second overhead vapor stream is provided by indirect heat exchange with a vaporizing refrigerant.

18. The process of claim 17 wherein the vaporizing refrigerant is a multi-component refrigerant.

19. The process of claim 16 wherein all or a portion of the refrigeration required to cool, condense, and subcool the second overhead vapor stream is provided by indirect heat exchange with a cold refrigerant provided by work expansion of a compressed refrigerant comprising nitrogen.

20. The process of claim 16 which further comprises cooling, condensing, and subcooling the stream enriched in methane in (d) to provide a liquefied methane-rich product.

21. The process of claim 20 wherein all or a portion of the refrigeration required to cool, condense, and subcool the stream enriched in methane is provided by indirect heat exchange with the vaporizing refrigerant.

22. The process of claim 20 wherein all or a portion of the refrigeration required to cool, condense, and subcool the stream enriched in methane is provided by indirect heat exchange with a cold refrigerant provided by work expansion of a compressed refrigerant comprising nitrogen.

23. The process of claim 20 wherein the liquefied methane-rich product is combined with the liquefied natural gas product.

24. The process of claim 1 wherein all or a portion of the cooling of the natural gas feed is provided by indirect heat exchange with one or more streams of vaporizing refrigerant.

25. The process of claim 24 wherein the vaporizing refrigerant is propane.

26. The process of claim 1 which further comprises providing a portion of the cooling of the natural gas feed by indirect heat exchange with a liquid bottoms stream from the absorber column, thereby providing a vaporized bottoms stream, and introducing the vaporized bottoms stream into the absorber column to provide boilup vapor.

27. A system for recovery of components heavier than methane from natural gas, wherein the system comprises (a) an absorber column for separating natural gas into a methane-rich stream and a stream enriched in components heavier than methane;

(b) cooling means to cool a natural gas feed to provide a cooled natural gas feed and means for introducing the cooled natural gas feed into the absorber column at a first location therein;

(c) means for withdrawing from the absorber column a first overhead vapor stream depleted in components heavier than methane and a bottoms stream enriched in components heavier than methane;

(d) means for introducing a methane-rich reflux stream at a second location in the absorber column above the first location;

(e) separation means for separating the bottoms stream into a stream enriched in methane and one or more streams enriched in components heavier than ethane; and (f) means for introducing an absorber liquid comprising components heavier than ethane into the absorber column at a location between the first location and the second location.

28. The system of claim 27 which further comprises means for cooling and partially condensing the first overhead vapor stream to form a two-phase stream and means for separating the two-phase stream to provide a second overhead vapor stream and the methane-rich reflux stream.

29. The system of claim 28 which further comprises a main heat exchanger having flow passages therein for cooling and partially condensing the first overhead vapor stream by indirect heat exchange with a vaporizing multi-component refrigerant, having flow passages therein for cooling a compressed multi-component refrigerant, pressure reduction means for reducing the pressure of the multi-component refrigerant to yield the vaporizing multi-component refrigerant, and means for distributing the vaporizing multi-component refrigerant in the main heat exchanger.

30. The system of claim 29 which further comprises additional flow passages in the main heat exchanger for cooling and at least partially condensing the second overhead vapor stream to provide a liquefied natural gas product.

31. The system of claim 30 which further comprises a product heat exchanger wherein the liquefied natural gas product is further cooled by indirect heat exchange with a cold refrigerant provided by work expansion of a compressed refrigerant comprising nitrogen.

* * * * *